US008393932B1

(12) United States Patent
Norman et al.

(10) Patent No.: US 8,393,932 B1
(45) Date of Patent: Mar. 12, 2013

(54) DOLL'S CLOTHING AND PLAY SET

(75) Inventors: Casey William Norman, London (GB); Torquil Patrick Alexander Norman, London (GB)

(73) Assignee: Genie Toys plc (GB)

( * ) Notice: Subject to any disclaimer, the term of this patent is extended or adjusted under 35 U.S.C. 154(b) by 1617 days.

(21) Appl. No.: 09/711,194

(22) Filed: Nov. 13, 2000
(Under 37 CFR 1.47)

Related U.S. Application Data

(63) Continuation-in-part of application No. 09/065,119, filed on Apr. 23, 1998, now Pat. No. 6,227,930.

(30) Foreign Application Priority Data

Jul. 24, 1997 (GB) ..... 9715596
Jan. 15, 1998 (GB) ..... 9800856.8

(51) Int. Cl.
*A63H 3/16* (2006.01)

(52) U.S. Cl. ..... 446/97; 446/98; 446/385

(58) Field of Classification Search ..... 446/385, 446/97–98; 2/69, 85, 87–88, 904
See application file for complete search history.

(56) References Cited

U.S. PATENT DOCUMENTS 2,283,238 A 5/1942 Thompson
2,359,948 A 10/1944 Tillotson
2,942,271 A 6/1960 Frankenfield
2,944,368 A * 7/1960 O'Brian et al. ..... 446/98
2,954,562 A 10/1960 Krupp
2,976,199 A 3/1961 Rand
3,206,533 A 9/1965 Serra
3,781,916 A 1/1974 Vitol
3,783,554 A * 1/1974 Shapero ..... 46/116
4,063,402 A * 12/1977 Washburn et al. ..... 53/258
4,067,064 A 1/1978 Cerniway et al.
4,227,340 A * 10/1980 Goldfarb et al. ..... 446/100
4,297,153 A * 10/1981 Erickson et al. ..... 156/63
4,297,313 A 10/1981 Duckstein (Continued)

FOREIGN PATENT DOCUMENTS

GB 835088 5/1960
GB 1294637 7/1971

(Continued)

OTHER PUBLICATIONS

U.S. Appl. No. 10/158,906, filed Jun. 1998, Kunie Koiwa.*

*Primary Examiner* — Bena Miller
(74) *Attorney, Agent, or Firm* — DLA Piper LLP (US)

(57) ABSTRACT

A doll's seamless garment which is adapted to be dressed, fitted and be removed in a life-like manner from a doll having a height in the range of above 8 cm to about 32 cm, wherein the doll is bendable at least in part. The garment is molded from an elastomeric material or rubber having an average modulus of elasticity of less than 1 MN/m$^2$. The garment wall thickness is preferably in the range of about 1 mm to about 3 mm. Further disclosed is a skin. The skin is adapted to be dressed, fitted and removed from a doll to transform the doll into a different character or object, and wherein the skin is molded in at least one part from an elastomeric material. The skin may have a wall thickness from 1 to 3 mm, the material having an average modulus of elasticity of less than 1 MN/m$^2$. The garments are easily manipulated by children and provide opportunities for creative play. Still further disclosed is a play set comprising, in cooperative combination, a doll donned and fitted with a garment.

18 Claims, 8 Drawing Sheets

U.S. PATENT DOCUMENTS 4,344,249 A * 8/1982 Goldfarb et al. ..... 46/151
4,414,774 A * 11/1983 Fogarty et al. ..... 446/98
4,420,176 A 12/1983 Cornwall
4,453,271 A 6/1984 Donzis
4,509,213 A 4/1985 Harvey
4,643,791 A 2/1987 Jurrius et al.
4,654,401 A 3/1987 Gallucci
4,681,564 A 7/1987 Landreneau
4,763,940 A 8/1988 Held
4,804,432 A 2/1989 Jurrius et al.
4,815,149 A 3/1989 Erhardt et al.
4,872,871 A 10/1989 Proxmire et al.
4,921,672 A 5/1990 Bock
4,940,464 A 7/1990 Van Gompel et al.
4,981,480 A 1/1991 Gaudet et al.
5,022,886 A 6/1991 Jenkins
5,082,875 A 1/1992 Tajima
5,093,422 A 3/1992 Himes
5,163,932 A 11/1992 Nomura et al.
5,186,673 A * 2/1993 Fogarty et al. ..... 446/98
5,194,034 A 3/1993 Heppenstall
5,196,240 A 3/1993 Stockwell
5,352,649 A 10/1994 Shibahashi et al.
5,357,636 A 10/1994 Dresdner, Jr. et al.
5,388,275 A 2/1995 Oram
5,423,087 A 6/1995 Krent
5,451,439 A 9/1995 Bigg
5,453,314 A 9/1995 Collier et al.
5,472,775 A 12/1995 Obijeski et al.
5,480,341 A 1/1996 Plakos
5,503,919 A 4/1996 Litchholt et al.
5,531,732 A 7/1996 Wood
5,553,399 A 9/1996 Strong
5,569,265 A 10/1996 Elliott
5,586,340 A * 12/1996 Russo ..... 2/67
5,603,122 A 2/1997 Kania
5,607,339 A * 3/1997 Kramer ..... 446/491
5,625,897 A 5/1997 Park
5,640,720 A 6/1997 Sandbank
5,643,396 A 7/1997 Rajala et al.
5,709,913 A 1/1998 Andersen et al.
5,718,669 A 2/1998 Marble
5,766,704 A 6/1998 Allen et al.
5,780,573 A 7/1998 Iwata et al.
5,913,708 A * 6/1999 Gross ..... 446/385
5,928,803 A 7/1999 Yasuda
6,227,930 B1 * 5/2001 Norman et al. ..... 446/268
6,228,804 B1 * 5/2001 Nakashima ..... 503/226

FOREIGN PATENT DOCUMENTS

GB 1518830 12/1975

* cited by examiner

DOLL'S CLOTHING AND PLAY SET

CROSS REFERENCES TO RELATED APPLICATION

This application is a continuation-in-part of application Ser. No. 09/065,119 filed Apr. 23, 1998, titled DOLL'S CLOTHING now U.S. Pat. No. 6,227,930, the entire disclosure including drawings of the co-pending application is incorporated herein by reference.

BACKGROUND OF THE INVENTION

1. Field of the Invention

The present invention relates to a doll's garment, a method for the manufacture thereof and to a play set comprising a doll and at least one garment therefor.

2. Description of the Related Art

Traditionally, doll's clothes are stitched from fabric. This is impracticable for making clothes for dolls smaller than about 4 cm in height, due to the difficulty experienced in forming the stitches. Even for larger dolls, stitching may be difficult for small garment features. Additionally, fabric clothing may not be as elastic as alternative materials, causing difficulties in donning garments on dolls, and therefore, limiting the degree to which a garment may be shaped to the doll form. Furthermore, fabric clothing is less durable than alternative materials.

Flexible or elastic articles not designed for doll clothing, generally have limitations which render them unsuitable for doll clothing. For example, U.S. Pat. No. 2,283,238 discloses a method of manufacturing sanitary elastic sheaths by a dipping process. The sheaths are comprised of bags having elastic bands attached at one end and may be used for items such as finger cots, thumb guards, rubber gloves and breast nipple sheaths. The item itself is not molded to fit to the shape of the form which it covers and requires the elastic band to secure the sheath in place. The bag-like nature of the articles does not allow for openings for arms and legs as is necessary in doll's clothing.

A molded latex article is disclosed in U.S. Pat. No. 3,206,533 for use as a girdle. The article is formed with a mesh-like network of multiple small holes to permit free breathing of the skin on which it is placed. An item such as this would not be suitable for doll's clothing primarily because of its perforated nature.

U.S. Pat. No. 4,297,153 discloses a method for making doll clothing and doll house accessories by molding a plastic film and thereafter attaching decorative elements. The elements are attached by moistening the film to which the element is to be attached. Providing detail in this manner may be difficult and time consuming, especially for small features. It also introduces a weakness in the article diminishing durability. Additionally, the method may limit the sizes and types of detail which may be added to the articles.

Various proposals have therefore been advanced for making articles simulating doll's clothing from alternative materials. For example, U.S. Pat. No. 4,414,774 describes fabricating such articles from plastic materials. Due to their degree of rigidty, the articles lack realism and appear bulky. In addition, once the doll is clothed, its limbs cannot be moved so that the articles are unsuitable for dolls with articulated limbs.

U.S. Pat. No. 4,763,940 discloses a finger mounted document handling aid. The aid is tubular and comprises a plurality of generally parallel longitudinal cuts to permit enhanced flexibility. Such an article would be difficult to adapt to realistic-looking doll's clothing because of the longitudinal cuts required for adequate flexibility. Furthermore, without the cuts the article may not be flexible enough to bend at joints of an articulated doll.

Therefore, there is a need for doll's clothing that can be realistically dressed on, adapted and fitted to the doll. Additionally, there is a need for garments that have sufficient flexibility to bend where the doll bends. Furthermore, there is a need for doll's garments made of a material suitable as to appearance for doll's clothing, and that may easily be manipulated by children. Furthermore, it is desirable to manufacture doll's clothing with these characteristics in a size appealing to and fun for a wide age range of children.

SUMMARY OF THE INVENTION

A doll's garment is provided that is durable and easily fitted to a doll and which may be more easily manufactured than a fabric garment. The garment may be an article of clothing or a skin that transforms the character of the doll. Both realistic and fanciful garment designs are possible according to embodiments of the invention. Also included is a play set comprising a lei doll and at least one garment.

One embodiment of the invention is a doll's seamless garment which is adapted to be dressed, fitted and be removed in a life-like manner from a doll having a height in the range of above 8 cm (3.1 in) to about 30 cm (11.8 in), wherein the doll is bendable at least in part. The garment is molded from an elastomeric material or rubber having an average modulus of elasticity of less than 1 $MN/m^2$. The garment wall thickness is preferably in the range of about 1 mm (0.039 in) to about 3 mm (0.118 in). Optionally, the garment comprises at least one integrally molded feature.

In another embodiment the garment is a skin. The skin is adapted to be dressed, fitted and removed from a doll to transform the doll into a different character or object. The skin is molded in at least one part from an elastomeric material. The elastomeric material selected from the group consisting of one of the following: ethylene vinyl acetate copolymer, styrene-butadiane-styrene, styrene-isoprene-styrene, styrene-diene, styrene-isoprene-butylene block copolymers containing mineral oil, branched styrene copolymer, styrene butadiene rubber, styrene-butadiene triblock rubber, styrene-isoprene-styrene linear block polymer, styrene-butadiene radial block copolymer, butadiene-styrene copolymer rubber and equivalent elastomeric materials. Preferably, the garment has a wall thickness from 1 to 3 mm and preferably the material has an average modulus of elasticity of less than 1 $MN/m^2$.

Yet another embodiment of the invention is a play set comprising, in cooperative combination, a doll donned and fitted with a garment as described above.

The garments of the invention are constructed of materials unlike those found in prior art doll clothing allowing sufficient flexibility to bend where the doll bends. The garments can be fitted or removed in a lifelike manner on any size dolls and are easily manipulated by even young children. Additionally, an articulated doll maintains its flexibility when clothed in the garment.

The invention will now be described, by way of example only, with reference to the accompanying drawings.

DETAILED DESCRIPTION OF THE DRAWINGS

DETAILED DESCRIPTION OF THE INVENTION

Figure 1A:
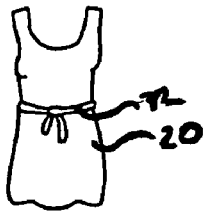
FIGS. 1A-1G depict a doll's garments according to embodiments of the invention.
Figure 1B:
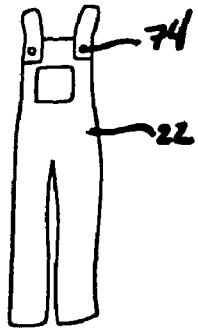
Figure 1C:
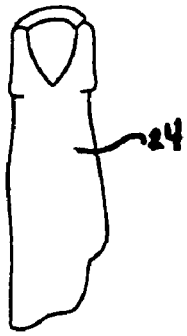
Figure 1G:
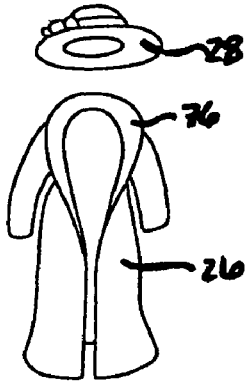
Figure 1D:
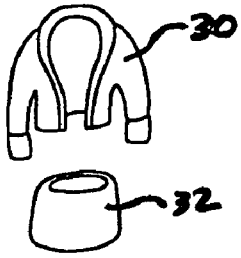
Figure 1E:
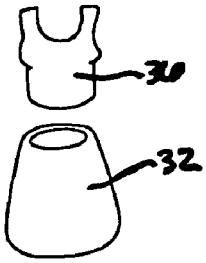

The present invention relates to an interchangeable doll's garment made preferably from an elastomeric material. The material may be selected from ethylene vinyl acetate copolymer (EVA) and any of the polymers sold under the registered trademark "Kraton" by Shell Chemical Co. (such as optionally hydrogenated) styrene-butadiene-styrene, styrene-isoprene-styrene, styrene-diene, styrene-isoprene and styrene-butadiene block copolymers, styrene-ethylene-butylene block copolymer containing mineral oil, branched styrene copolymer, styrene-butadiene rubber, styrene-butadiene triblock rubber, styrene-isoprene-styrene linear block polymer, styrene-butdiene radial block copolymer, butadiene-styrene-copolymer rubber, synthetic rubber) or equivalent materials.

Preferably, the average modulus of elasticity of the material is less than about 1 $MNm^{-2}$. More preferably, the 100% modulus of elasticity, measured at a standard test speed of about 500 mm/min, is between about 120 and 350 $kNm^{-2}$, and still more preferably between 240 and 280 $kNm^{-2}$. The 300% modulus of elasticity may lie between about 440 and 490 $kNm^{-2}$. Such values provide a material from which garments with sufficient realism and desired features can be molded, whilst avoiding increased difficulty molding detail and in removal of the molded garments from the mold, which the inventors have found to occur with highly elastic polymers. The nature of the elastomeric material allows a child to manipulate the garments to dress and undress the doll with minimum of frustration.

The wall thickness of the garment is preferably from about 1 mm (0.039 in) to about 3 mm (0.118 in). However, garments may have wall thicknesses of any dimension that allow the garment to be dressed on, fitted to and removed from the doll or over other garments. The material elasticity and garment wall thickness provide durability to enable garments to be donned on and removed from a doll repeatedly. Desired realism and flexibility may also be achieved with materials having these properties. Garments formed from materials having these properties may be manipulated by young children with minimum frustration that accompanies use of some dolls' clothing, even when fitted to dolls of about 4 to 32 cm.

One embodiment of the present invention provides a method of manufacturing a doll's garment, comprising molding an elastomeric material or rubber. Preferably, the garment is injection molded. However, any method by which elastomeric or rubber material having the parameters described herein can be formed into the garments described herein is within the spirit and scope of the invention.

Another embodiment of the invention provides a play set comprising a doll 10 having at least one articulated body part 50 and at least one garment for the doll, the garment(s) being made from an elastomeric material or rubber. The play set may also include garments that are clipped to the doll 10 or to other garments.

The doll 10 of the invention is preferably bendable at least in part by being articulated at isolated locations or by having continuously flexible parts. The degree of movement may go beyond that which is realistic or natural, so that a child may dress and undress the doll easily. Doll parts may be positioned and repositioned, with and without garments provided thereon.

An articulated doll may be jointed at the shoulders, hips, waist, neck, head, ankles, wrists, elbows and/or knees. It is also possible for the doll 10 to be articulated at points where joints are not naturally located to provide additional flexibility to facilitate dressing and undressing the doll. The junctions of articulated parts 50 may be exposed or, for a more realistic appearance, they may have a continuous coating that conceals the joint while allowing desired movement. Any combination of articulated parts is within the spirit and scope of the invention.

A continuously flexible doll may be continuously flexible throughout or only have some continuously flexible portions. A continuously flexible portion is a bendable portion in which there is no definable joint. Such flexibility may be achieved by utilization of a material having the desired bendability or by a combination of flexible materials. For example, the doll may comprise a flexible elastomeric material or rubber body having metal wire therein to provide durability and/or to enable the doll to maintain desired positions. The wire or a wire-like material may be throughout the body or within only a portion of the body. In one embodiment the doll comprises a combination of continuously flexible portions and articulated parts. For example, the doll may have continuously bendable arms and legs, and a head articulated at the neck.

The clothing may be designed so that it is possible to turn the particular garment inside-out. This has the advantage of still being able to be donned, but with new colors and/or decoration and/or detailing. Such a feature would be applicable to, for instance, hats 28, jackets 30 and pants 34. It also could be applied to the other coverings discussed, such as second skins.

To the elastic clothing there can be added fabric, by stitching the fabric on to the elastic portion. The elastic molded clothing can be decorated with actual frills, and other fabric portions to make new clothing designs.

Figure 4A:
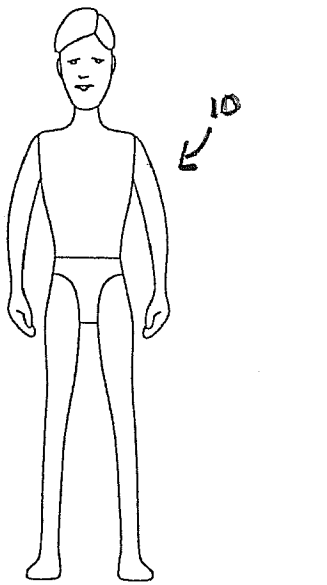
FIGS. 4A-4D depict a male doll with a removable head according to an embodiment of the invention and the male doll fitted in garments according to an embodiment of the invention.
Figure 4B:
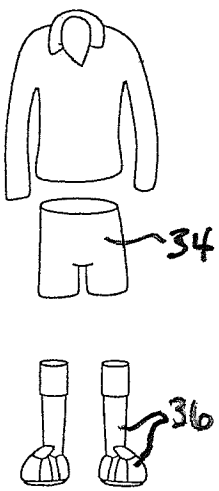
Figure 4C:
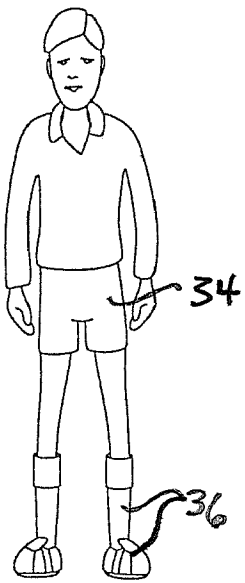
Figure 4D:
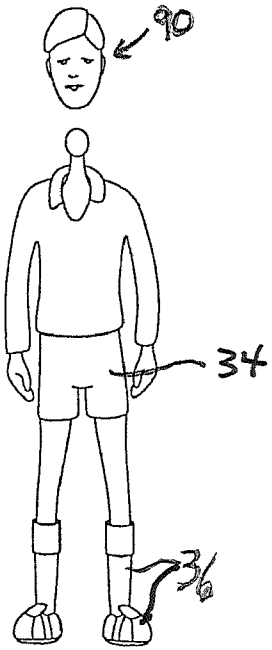

A particular embodiment of the invention includes the doll having one or more body parts removable at the point of articulation 50. FIG. 4D depicts a male doll with a removable head 90. Removable body parts allow garments of many design dimensions to be easily dressed on and removed from the doll, particularly for smaller children. For example a garment having a neckline diameter smaller than or substantially similar to the head diameter will be more easily fitted on the doll if the head is removed. Removable arms, legs, feet and hands will similarly facilitate dressing and undressing of the doll.

Figure 5A:
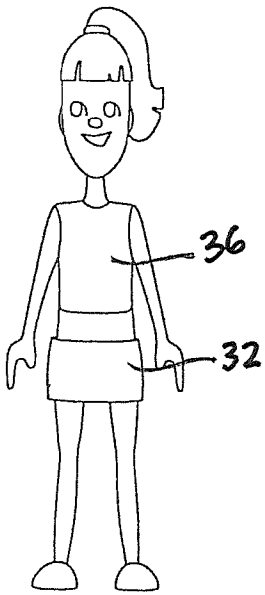
FIGS. 5A-5E depict garments having slits according to an embodiment of the invention and the doll of FIGS. 2A-2F fitted in garments having slits.
Figure 5B:
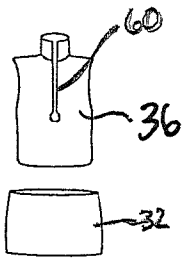
Figure 5C:
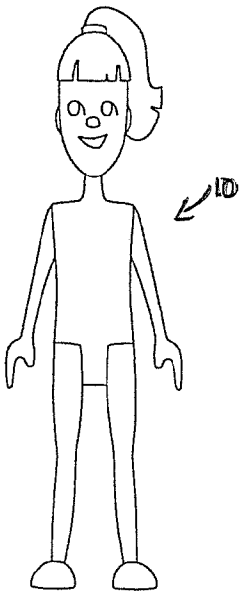
Figure 5D:
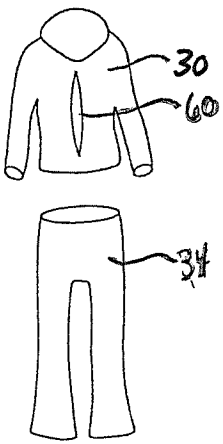
Figure 5E:
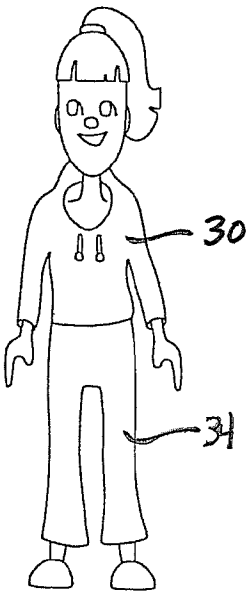

To further facilitate dressing of and removing the garment from the doll an embodiment of the invention includes garments having one or more slits 60 as depicted in FIGS. 5B and 5D. The slit(s) 60 is preferably in the back of the garment. However, slits 60 may be placed anywhere in the garment that would facilitate dressing and undressing of the doll. A slit having a length in the range of about 10% to about 50% of the length of the garment is preferred. Lengths shorter than this may not adequately enhance the ease by which the doll may be dressed or undressed. Slits 60 longer than this may cause the garment to gape open. Preferably the slit(s) 60 has a closed end forming a radius to prevent tearing. However, any reinforcing method may be used that does not adversely limit the flexibility of the garment. FIGS. 5A and 5C depict the doll 10 of FIGS. 2A-2F fitted in garments (20-34) having slits 60.

It should be understood however that these embodiments do not imply that all garments having small dimensions, such as neckline or cuff diameters, cannot be fitted on the doll without removal of a body part or incorporation of a slit in the garment.

Parent application Ser. No. 09/065,119 provides a preferred embodiment of garments adapted to dolls having a size of less than 8 cm (3.1 in). However, the doll 10 may be any size but is likely to be found most appealing to children when in the range of about preferably 4 cm (1.6 in) to about 30 cm (11.8 in). Dolls 10 in the range of above 8 cm (3.1 in) to about 32 cm (12.6 in) may be easiest for small children to dress and undress. Dolls 10 in the range of about 29 cm (11.4 in) to about 32 cm (12.6 in) are generally suitable for imaginative play involving repeatedly changing garments. Dolls 10 of the following approximate height/width ratios are suitable for children of a wide age range: for female dolls 4.3:1, 4.1:1, 3.9:1 and 3.8:1 wherein, for example, the dolls may have heights of about 29.2 cm (11.5 in), 9.5 cm (3.7 in), 18 cm (7.1 in) and 4.6 cm (1.8 in), respectively; for male dolls about 3:1, 3.1:1, and 2.9:1 wherein, for example, the dolls may have heights of 7.2 cm (2.8 in), 8.5 cm (3.3 in) and 13 cm (5.1 in), respectively. These proportions and/or sizes are generally more realistic than popular dolls on the market today. Additionally, dolls of these proportions and/or sizes with flexible garments adapted to be dressed thereon, fitted thereto and removed therefrom are not generally seen in today's market and will be a fun change for children. All embodiments of the invention are applicable to dolls of any shape and size, and further to male, female, human, nonhuman and fanciful figures. Fanciful figures may include, but are not limited to, superheros, monsters, robots and cartoon characters. Dolls may be formed having sculpted hair or rooted hair. Although rooted hair requires additional manufacturing process steps, it provides a more realistic doll.

Figure 6C:
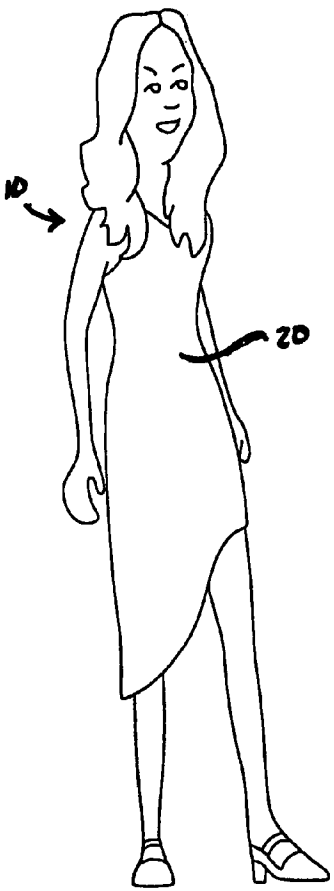
FIGS. 6A-6C depict a doll and garment according to embodiments of the invention and the doll fitted in the garment.
Figure 6B:
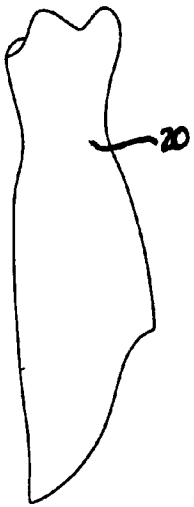
Figure 6A:
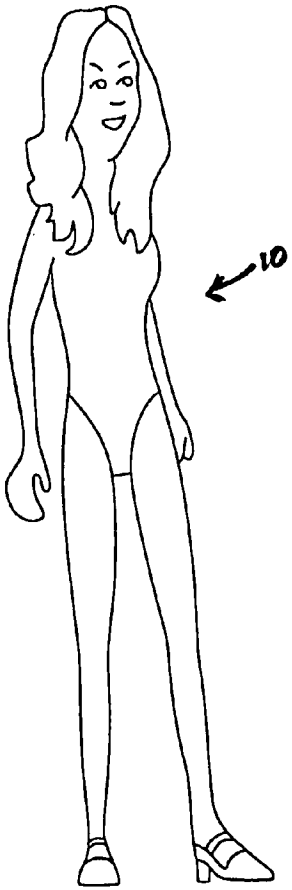
Figure 7C:
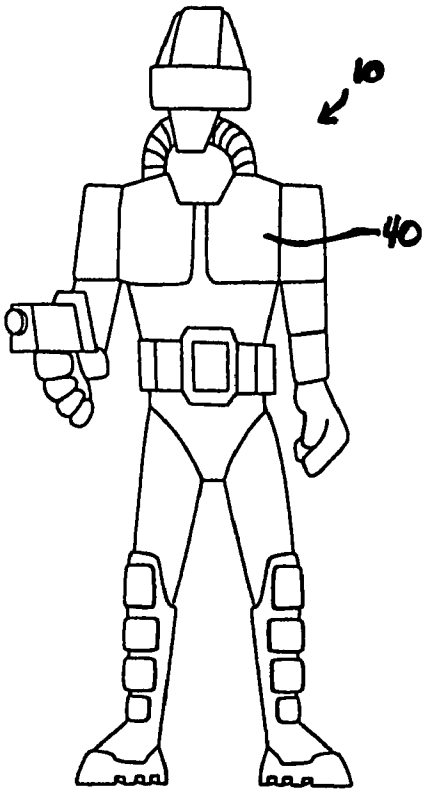
FIGS. 7A-7C depict a doll and skin according to an embodiment of the invention and a doll fitted with the skin.
Figure 7B:
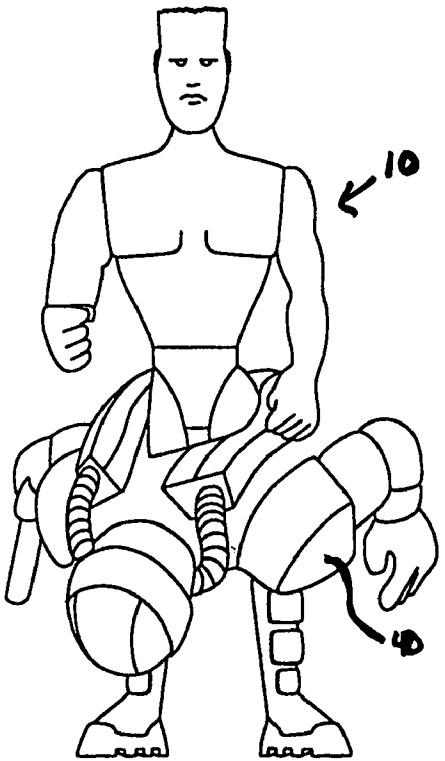
Figure 7A:
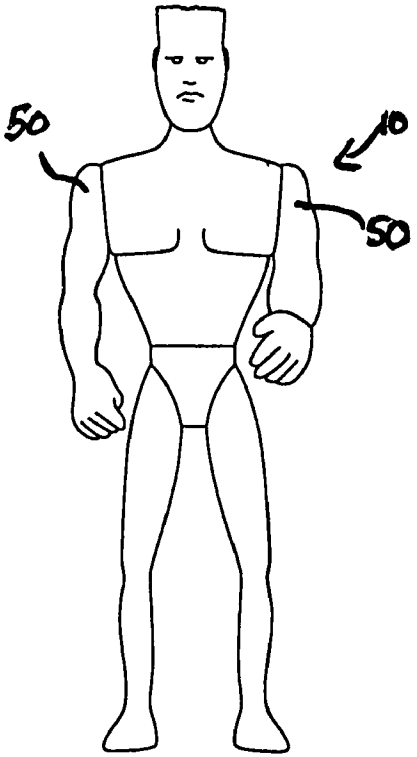
Figure 8C:
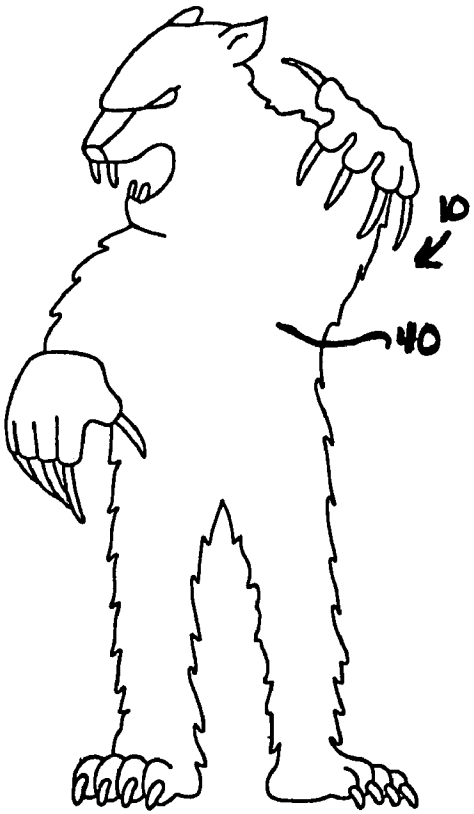
FIGS. 8A-8C depict a doll and skin according to another embodiment of the invention and a doll fitted with the skin.
Figure 8B:
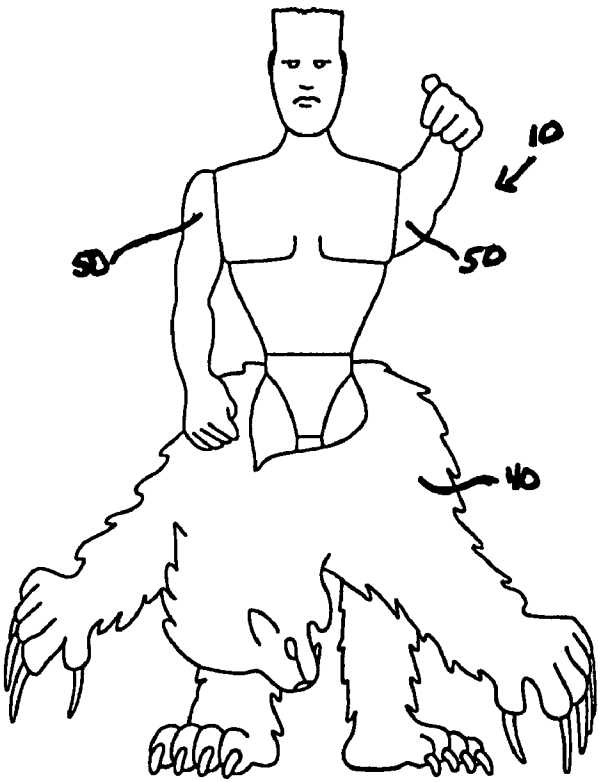
Figure 8A:
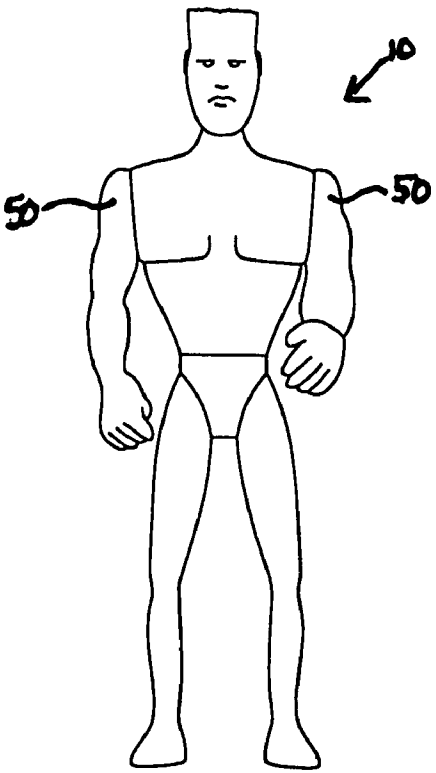

FIGS. 1A to 1G show various injection-molded garments for a doll 10 approximately 4 cm in height. However, the garments may be fabricated for use with dolls of any size. More specifically, FIG. 1A shows a dress 20, FIG. 1B a pair of dungarees 22, FIG. 1C a gown 24, FIG. 1D a jacket 30 and a skirt 32, FIG. 1E a vest 36 and skirt 32, FIG. 1F a jacket 30 and a pair of slacks 34 and FIG. 1G a hat and a coat. The garments may further include T-shirts, swim wear, pants, pajamas, suits, shirts, coats, shorts, cloaks, capes, uniforms, hats, shoes, helmets, armor and scarfs. Garments may also be those from any of the following categories: athletic wear, evening wear, uniforms, casual wear, sleep wear, business attire, school wear or costumes. The garments may be styled for a particular type or character of doll. For example, a film star, recording star or teenage doll may have garments reflecting such identities. FIGS. 6A-6C depict a glamorous doll 10 and a garment (gown 20) designed to reflect that which a glamorous character, such as a film star would wear. Garments may comprise a combination of two or more articles which would typically exist as separate articles. For example, as shown in FIG. 4B, a sock and shoe 36 may be molding to form a single garment.

The garments are molded from elastomeric materials or rubber and are therefore noticeably flexible and elastic, which provides a high degree of realism as compared with prior art garment-simulating articles. The realism may be further enhanced by decorating the garment using paint, varnish, glitter, or other coatings compatible with the elastomeric or rubber material. Some examples of other coatings include color-change or glow-in-the-dark coatings. In a particular example, the garments are molded from clear Kraton and painted with a paint of which the modulus of elasticity is compatible with that of the Kraton. Additionally, details may be provided by the molding process. Integrally molded details provide greater garment durability compared to garments having details applied after their formation. Attached features may separate from a garment, especially if the garment is stretched as would be the case when donning an elastic-type garment on a doll. Integrally molded details stretch with the garment and therefore, will not undergo stress that may lead to separation. Details may include but are not limited to, items found on clothing such as belts 72, buttons 74 and collars 76, animal features such as horns or beaks, or robot components such as lights and buttons (not shown). It will be understood by those skilled in the art that molding processes will allow nearly any type of detail imaginable to be molded integrally with the garment.

Figure 2A:
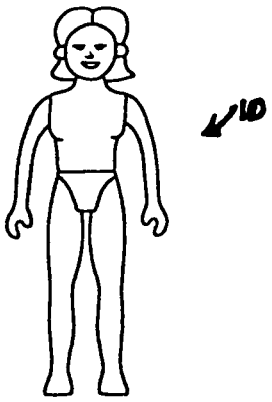
FIGS. 2A-2F depict a doll according to an embodiment of the invention.
Figure 2B:
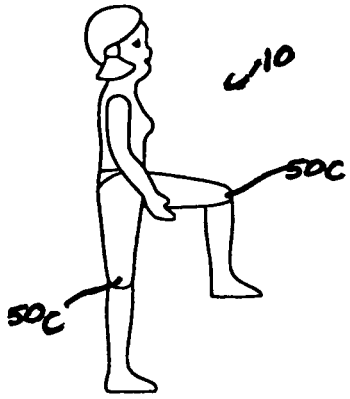
Figure 2C:
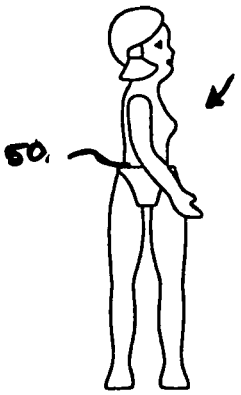
Figure 2D:
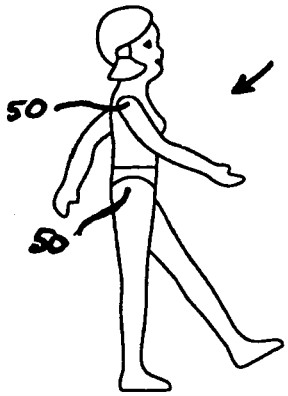
Figure 2E:
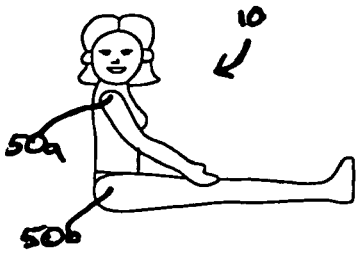
Figure 2F:
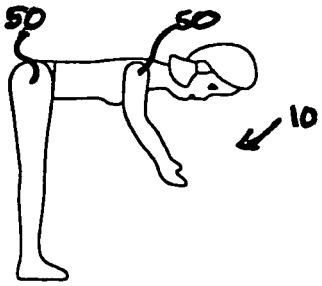
Figure 3A:
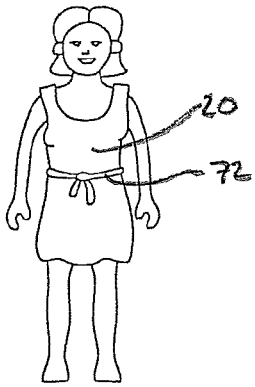
FIGS. 3A-3F depict the doll of FIGS. 2A-2F dressed in the garments of FIGS. 1A-1G respectively.
Figure 3B:
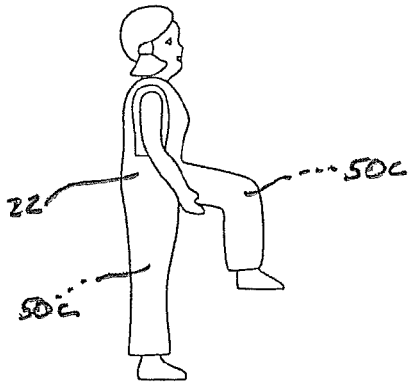
Figure 3C:
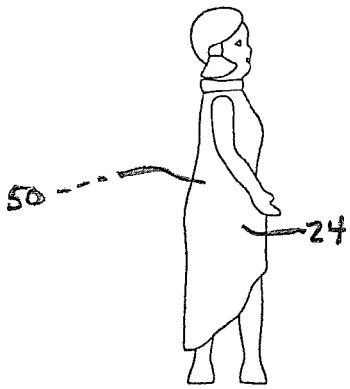
Figure 3D:
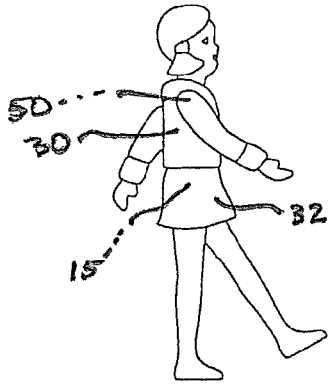
Figure 3E:
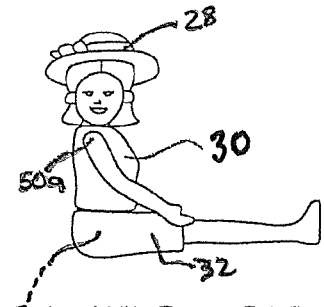
Figure 3F:
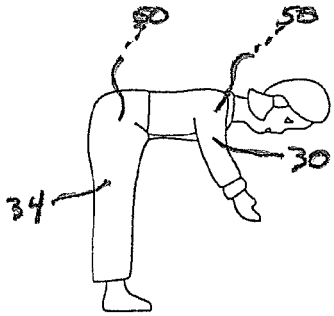

FIGS. 2A and 2F show a three-dimensional doll 10 which is approximately 4 cm in height. The doll 10 is assembled from injection-molded plastics components and is articulated at the shoulders 50*a*, hips 50*b* and knees 50*c*.

Figure 1F:
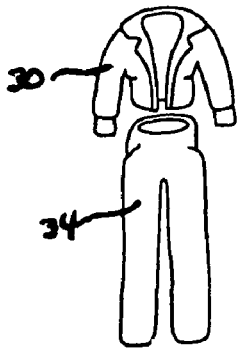

FIGS. 3A to 3F show the doll 10 of FIGS. 2A to 2F after fitting of the garments shown in FIGS. 1A and 1F respectively. Due to their elasticity, the garments can be fitted in a life-like way, i.e., jackets are donned "arms first" and dresses, trousers and skirts are stepped into. However, upper garments may be more easily donned over the feet due to the diameter of the doll's head and the usual positioning of the arms. Once clothed, the doll's limbs can still be moved. The garments are easily interchanged, even by younger children. One garment can be donned over another, for example a jacket 30 over a dress 20 or a vest 36 over a shirt. Garments not generally worn on top of one another may be layered to provide a child with additional fun and creative opportunities. For example, athletic wear may be donned under formal wear or vice-versa.

In addition, the term "garment" as used in this specification should be understood to include any flexible article which can be fitted to the external surface of a doll or on top of other garments, including second skins 40. Skins 40 are garments that transform a doll 10 into a different character or into an object. For example, skins 40 may resemble other animals, creatures or objects such as rocks, flames, bones or the like.

FIGS. 7A-7C and FIGS. 8A-8C depict human dolls 10 and garments in the form of skins 40 to transform the dolls 10 into a robot and a werewolf character, respectively. Both the doll 10 and the skin 40 may have any real or imaginary character. For example, an animal doll may be fitted with a human skin or superhero skin or a human doll may be fitted with an animal skin or a skin depicting an object. Skins may also be donned one on top of another or over or under clothing-like garments. For example, pants and tops may be placed over an animal skin, an animal or object skin may be placed over a clothed doll, or a human doll may be dressed with two or more skins. The possibilities are numerous and promote a child's use of his/her imagination and allow a child to delight in the surprise of exposing a hidden form, outfit, character or object. The skins may be designed to cover some or all of the doll, depending on the transformation desired. Skins may conform to a specific doll shape or may be of ample size and shape to fit a variety of doll forms.

While the invention has been described in what is presently considered to be preferred embodiments, many variations and modifications will become apparent to those skilled in the art. Accordingly, it is intended that the invention not be limited to specific illustrative embodiments but be interpreted within the full spirit and scope of the appended claims.

What is claimed is:

1. A seamless doll's skin comprising a seamless, injection molded elastomeric material sized and shaped to approximate the size and shape of at least a portion of a doll that is at least partially bendable or articulated which repeatedly covers and is removed from the doll and transforms the doll into a different character or object, has a wall thickness from 1 to 3 mm, has a through hole to accommodate passage of a doll's head or limb(s) and is sufficiently flexible and elastic to bend at bending or articulation locations of the doll.

2. The skin of claim 1 wherein the elastomeric material is a synthetic polymer.

3. The skin of claim 2 which is a copolymer.

4. The skin of claim 3 wherein the copolymer is selected from the group consisting of one of the following: ethylene vinyl acetate copolymer, styrene-butadiane-styrene, styrene-isoprene-styrene, styrene-diene, styrene-isoprene-butylene block copolymers containing mineral oil, branched styrene copolymer, styrene butadiene, styrene-butadiene triblock, styrene-isoprene-styrene linear block polymer, styrene-butadiene radial block copolymer, butadiene-styrene copolymer.

5. The skin of claim 1 wherein the garment is adapted in size to be fitted to and removed from the doll having a height of less than about 8 cm.

6. The skin of claim 1 wherein the garment is adapted in size to be fitted to and removed from the doll having a height of above 8 cm to about 20 cm.

7. The skin of claim 1 in a form selected from the group consisting of animal, human, monster, super hero, robot, and cartoon character.

8. A doll's skin comprising a seamless, injection molded elastomeric material which covers and is removed from at least a portion of a doll that is at least partially bendable or articulated and transforms the doll into a different character or object, wherein the elastomeric material has a 100% modulus of elasticity between about 120 and 350 $KN/m^2$, has a through hole to accommodate passage of a doll's head or limb(s) and is sufficiently flexible and elastic to bend at bending or articulation locations of the doll.

9. A seamless doll's garment comprising a seamless, injection molded elastomeric material having a molded shape to repeatedly fit over and removed from a doll having a height in the range of above 8 cm to about 20 cm, has a through hole to accommodate passage of a doll's head or limb(s) and is sufficiently flexible and elastic to bend at articulation locations of the doll.

10. The doll's garment of claim 9 wherein the elastomeric material is a synthetic polymer.

11. The doll's garment of claim 10 further comprising at least one integrally molded detail.

12. A doll's skin comprising a seamless, injection molded elastomeric material which covers and is removed from at least a portion a doll that is at least partially bendable or articulated to transform the doll into a different character or object, and wherein the elastomeric material has a 100% modulus of elasticity between 120 and 350 $KN/m^2$, has a through hole to accommodate passage of a doll's head or limb(s) and is sufficiently flexible and elastic to bend at bending or articulation locations of the doll.

13. The doll's skin of claim 12 wherein the elastomer material has a 100% modulus of elasticity between 240 and 280 $KN/m^2$.

14. A play set comprising, in cooperative combination, a doll that is at least partially bendable or articulated and having a height in the range of 8 cm to about 20 cm, donned and fitted with a seamless synthetic polymer injection molded garment which removably encloses around at least a part of the doll and is adapted to be removed, dressed and refitted again to the doll wherein the synthetic polymer has a 100% modulus of elasticity between about 120 and 350 $KN/m^2$, has a through hole to accommodate passage of a doll's head or limb(s) and is sufficiently flexible and elastic to bend at bending or articulation locations of the doll.

15. The play set of claim 14 wherein the doll is articulated at one or more of the following: shoulders, elbows, knees, wrists, ankles, neck, head and hips.

16. The play set of claim 14 wherein the synthetic polymer has a 100% modulus of elasticity between about 240 and 280 $KN/m^2$.

17. A seamless doll's garment comprising a seamless, injection molded elastomeric material sized and shaped to approximate the size and shape of at least a portion of a doll that is at least partially bendable or articulated which is repeatedly fitted over and removed from the doll, has a wall thickness from 1 to 3 mm, has a through hole to accommodate passage of a doll's head or limb(s) and is sufficiently flexible and elastic to bend at bending or articulation locations of the doll.

18. A seamless doll's garment comprising a seamless, injection molded elastomeric material sized and shaped to approximate the size and shape of at least a portion of a doll that is at least partially bendable or articulated which is repeatedly fitted over and removed from the doll, wherein the elastomeric material has a 100% modulus of elasticity between 120 and 350 $KN/m^2$, has a through hole to accommodate passage of a doll's head or limb(s) and is sufficiently flexible and elastic to bend at bending or articulation locations of the doll.

* * * * *